US011858045B2

(12) United States Patent
Matsugi et al.

(10) Patent No.: US 11,858,045 B2
(45) Date of Patent: Jan. 2, 2024

(54) FE-BASED SINTERED BODY, FE-BASED SINTERED BODY PRODUCTION METHOD, AND HOT-PRESSING DIE

(71) Applicants: Hiroshima University, Hiroshima (JP); Y-tec Corporation, Hiroshima (JP); KEYLEX CORPORATION, Hiroshima (JP); Mazda Motor Corporation, Hiroshima (JP)

(72) Inventors: Kazuhiro Matsugi, Hiroshima (JP); Yujiao Ke, Hiroshima (JP); Zhefeng Xu, Hiroshima (JP); Kenjiro Sugio, Hiroshima (JP); Yongbum Choi, Hiroshima (JP); Gen Sasaki, Hiroshima (JP); Hajime Suetsugu, Hiroshima (JP); Hiroki Kondo, Hiroshima (JP); Hideki Manabe, Hiroshima (JP); Kyotaro Yamane, Hiroshima (JP); Kenichi Hatakeyama, Hiroshima (JP); Keizo Kawasaki, Hiroshima (JP); Tsuyoshi Itaoka, Hiroshima (JP); Shinsaku Seno, Hiroshima (JP); Yasushi Tamura, Tokyo (JP); Ichirou Ino, Hiroshima (JP); Yoshihide Hirao, Hiroshima (JP)

(73) Assignees: Hiroshima University, Hiroshima (JP); Y-tec Corporation, Hiroshima (JP); keylex corporation, Hiroshima (JP); Mazda Motor Corporation, Hiroshima (JP)

( * ) Notice: Subject to any disclaimer, the term of this patent is extended or adjusted under 35 U.S.C. 154(b) by 29 days.

(21) Appl. No.: 17/266,375

(22) PCT Filed: Jul. 24, 2019

(86) PCT No.: PCT/JP2019/029057

§ 371 (c)(1),
(2) Date: Feb. 5, 2021

(87) PCT Pub. No.: WO2020/031702

PCT Pub. Date: Feb. 13, 2020

(65) Prior Publication Data

US 2021/0308756 A1 Oct. 7, 2021

(30) Foreign Application Priority Data

Aug. 7, 2018 (JP) ..... 2018-148885

(51) Int. Cl.
*B22F 3/105* (2006.01)
*B22F 3/00* (2021.01)
(Continued)

(52) U.S. Cl.
CPC ..... *B22F 3/105* (2013.01); *B22F 3/004* (2013.01); *B22F 3/14* (2013.01); *B22F 9/04* (2013.01);
(Continued)

(58) Field of Classification Search
CPC ..... C22C 1/05–053; C22C 33/0228
See application file for complete search history.

(56) References Cited

U.S. PATENT DOCUMENTS 3,809,540 A 5/1974 Mal
3,942,954 A 3/1976 Fritz
(Continued)

FOREIGN PATENT DOCUMENTS

CN 101104903 A 1/2008
CN 101525716 A * 9/2009
(Continued)

OTHER PUBLICATIONS

Shackelford, James F. Alexander, William. (2001). CRC Materials Science and Engineering Handbook (3rd Edition); p. 393 (Year: 2001).*

(Continued)

*Primary Examiner* — Alexandra M Moore
*Assistant Examiner* — Austin Pollock
(74) *Attorney, Agent, or Firm* — Casimir Jones, S.C.; Tanya A. Arenson

(57) ABSTRACT

Provided is a Fe-based sintered body which has both of a high hardness and a high thermal conductivity and which (Continued)

can be more stably produced. The Fe-based sintered body includes: a matrix (1) containing Fe as a main component; and a hard phase (4) dispersed in the matrix (1). The matrix (1) is formed in a network shape and contains αFe. The hard phase (4) contains TiC.

15 Claims, 9 Drawing Sheets

(51) Int. Cl.

| | |
|---|---|
| ***B22F 3/14*** | (2006.01) |
| ***B22F 9/04*** | (2006.01) |
| ***C22C 33/02*** | (2006.01) |
| ***C22C 38/00*** | (2006.01) |

(52) U.S. Cl.
CPC ..... *C22C 33/0292* (2013.01); *C22C 38/00* (2013.01); *B22F 2003/1051* (2013.01); *B22F 2009/043* (2013.01); *B22F 2301/35* (2013.01); *B22F 2302/05* (2013.01)

(56) References Cited

U.S. PATENT DOCUMENTS

| | | | | | |
|---|---|---|---|---|---|
| 3,967,935 | A | * | 7/1976 | Frehn | C22C 33/0292 419/17 |
| 3,999,952 | A | * | 12/1976 | Kondo | C22C 33/0228 419/12 |
| 4,704,336 | A | * | 11/1987 | Spriggs | C23C 24/082 75/242 |
| 6,652,616 | B1 | | 11/2003 | Berns et al. | |
| 2010/0189592 | A1 | | 7/2010 | Angles | |
| 2014/0023551 | A1 | | 1/2014 | Angles | |
| 2017/0268084 | A1 | | 9/2017 | Angles | |

FOREIGN PATENT DOCUMENTS

| | | | | | |
|---|---|---|---|---|---|
| JP | 48-029965 | | | 9/1973 | |
| JP | S-48029965 | B | * | 9/1973 | C22C 33/02 |
| JP | 49-098307 | | | 9/1974 | |
| JP | 50-20947 | B | | 7/1975 | |
| JP | 62-177159 | | | 8/1987 | |
| JP | 02-263947 | | | 10/1990 | |
| JP | 03-017246 | | | 1/1991 | |
| JP | 11323401 | A | * | 11/1999 | |
| JP | 2000-273503 | | | 10/2000 | |
| JP | 2015-221941 | | | 12/2015 | |
| JP | 2018-053308 | | | 4/2018 | |

OTHER PUBLICATIONS

AZO Materials; Chromium; retrieved from internet on May 19, 2022; https://www.azom.com/article.aspx?ArticleID=9081 (Year: 2022).*

Azo Materials; Molybdenum; retrieved from internet on May 19, 2022; https://www.azom.com/article.aspx?ArticleID=7637 (Year: 2022).*

Azo Materials, "TiB2 Properties and Applications", retrieved from the internet on Nov. 30, 2022; https://www.azom.com/article.aspx?ArticleID=492 (Year: 2022).*

Office Action for Chinese Patent Application No. 201980052043.5, dated Sep. 1, 2021, 14 total pages.

English translation of International preliminary report on patentability of PCT/JP2019/029057, dated Feb. 18, 2021, 8 pages.

International Search Report for PCT/JP2019/029057, dated Aug. 27, 2019, 2 pages.

Extended European Search Report for 19846080.0, dated Jun. 20, 2022, 11 pages.

* cited by examiner (a)

(b)

| | | ELEMENT | | | |
|---|---|---|---|---|---|
| | | Fe | Ti | B | C |
| | | at. % | | | |
| NUMBER | (1) | 68.0 | 18.8 | 2.3 | 10.9 |
| | (2) | 92.8 | 3.6 | 0 | 3.6 |
| | (3) | 61.6 | 20.0 | 5.5 | 12.9 |
| | (4) | 7.9 | 27.7 | 61.7 | 2.7 |
| | (5) | 8.5 | 32.2 | 56.5 | 2.8 |
| | (6) | 66.7 | 8.7 | 21.8 | 2.8 |
| | (7) | 68.3 | 1.9 | 29.2 | 0.6 |
| | (8) | 96.8 | 2.2 | 0 | 1.0 |

FIG. 6

| | SINTERING TEMPERATURE (K) | $TiB_2$ CONCENTRATION AT SURFACE OF SINTERED BODY (vol%) | $TiB_2$ CONCENTRATION INSIDE SINTERED BODY (vol%) | TC/ $W \cdot m^{-1} \cdot K^{-1}$ | $H_V$ (SURFACE) | $H_V$ (CROSS SECTION) | DENSITY $\rho$ ($g \cdot cm^{-3}$) | RELATIVE DENSITY (%) |
|---|---|---|---|---|---|---|---|---|
| COMPARATIVE EXAMPLE 1 | 1273 | 27.4 | 28.9 | 44.3±3.7 | 228±6 | 214±7 | 6.03 | 87.8 |
| EXAMPLE 1 | 1323 | 25.0 | 27.1 | 38.0±3.1 | 316±7 | 303±16 | 6.19 | 90.2 |
| EXAMPLE 2 | 1373 | 23.5 | 24.9 | 38.7±1.8 | 401±13 | 364±14 | 6.41 | 93.4 |
| EXAMPLE 3 | 1423 | 18.8 | 20.1 | 48.0±2.0 | 742±30 | 536±34 | 6.54 | 95.3 |

FIG. 8

| | HOLDING TIME AT 1373K (s) | $TiB_2$ CONCENTRATION AT SURFACE OF SINTERED BODY (vol%) | $TiB_2$ CONCENTRATION INSIDE SINTERED BODY (vol%) | TC/ $W \cdot m^{-1} \cdot K^{-1}$ | $H_V$ (SURFACE) | $H_V$ (CROSS SECTION) | DENSITY $\rho$ ($g \cdot cm^{-3}$) | RELATIVE DENSITY (%) |
|---|---|---|---|---|---|---|---|---|
| EXAMPLE 4 | 0 | 23.5 | 24.9 | 38.7±1.8 | 401±13 | 364±14 | 6.41 | 93.4 |
| EXAMPLE 5 | 300 | 22.34 | 23.1 | 52.6±6.8 | 597±13 | 522±10 | 6.54 | 95.2 |
| EXAMPLE 6 | 600 | 20.51 | 21.3 | 60.0±5.0 | 623±11 | 544±11 | 6.71 | 97.7 |

(a)

(b)

| | SINTERING TEMPERATURE (K) | HOLDING TIME (s) | TC/ $W \cdot m^{-1} \cdot K^{-1}$ | $H_V$ (SURFACE) | DENSITY $\rho$ ($g \cdot cm^{-3}$) | RELATIVE DENSITY (%) |
|---|---|---|---|---|---|---|
| EXAMPLE 7 | 1373 | 600 | 38.7±1.8 | 366±8.3 | 6.97 | 98.2 |

FE-BASED SINTERED BODY, FE-BASED SINTERED BODY PRODUCTION METHOD, AND HOT-PRESSING DIE

TECHNICAL FIELD

The present invention relates to a Fe-based sintered body, a method of producing the Fe-based sintered body, and a hot press die.

BACKGROUND ART

Conventionally, a hot press technique has been used, for example, in manufacture of automobile body components and the like. In the hot press technique, a steel sheet in a heated state is molded (press-molded) by pressing the steel sheet with use of a hot press die. In this press molding, steel is hardened by rapid cooling (quenching). Such a hot press technique has become a key technique for ensuring molding accuracy and strength after molding, in manufacture of products (components) using a super high tensile steel.

The hot press die is required to achieve performance such as high durability that allows for repeated use (longer life) and high capability of being cooled. The higher the capability of being cooled becomes, the shorter one cycle time of the press molding can be. In other words, it is desirable that the hot press die is made of a material which has both of a high hardness and a high thermal conductivity.

Patent Literature 1 discloses a technique for improving a thermal conductivity of a tool steel at room temperature.

CITATION LIST

Patent Literature

[Patent Literature 1]

Japanese Patent Application Publication Tokukai No. 2015-221941

SUMMARY OF INVENTION

Technical Problem

In general, for example, SKD61 is known as a material of a hot press die. This material has a Rockwell hardness of approximately 50 $H_RC$. On the other hand, a thermal conductivity of the material is approximately 24 W/(m·K), and further improvement of this thermal conductivity is required. However, in general, there is a trade-off between having a high hardness and having a high thermal conductivity as characteristics of a material. Therefore, it is difficult to obtain a material which has both of a high hardness and a high thermal conductivity.

Patent Document 1 discloses a tool steel having an improved thermal conductivity at room temperature, by metallurgically defining an internal structure of steel. However, since it is difficult to precisely control the internal structure of steel, the tool steel has a problem in that stable production of the tool steel is difficult.

In view of the above-described current circumstances, the present invention has been attained. An object of the present invention is to provide a Fe-based sintered body (material of a hot press die) which has both of a high hardness and a high thermal conductivity and which can be more stably produced. It is also an object of the present invention to provide a method of producing a Fe-based sintered body, which method makes it possible to more stably produce a Fe-based sintered body having both of a high hardness and a high thermal conductivity.

Solution to Problem

In order to solve the above problems, a Fe-based sintered body in accordance with an aspect of the present invention includes: a matrix containing Fe as a main component; and a dispersed phase in the matrix, the matrix being formed in a network shape and containing αFe, and the dispersed phase containing TiC.

In order to solve the above problems, a method of producing a Fe-based sintered body in accordance with an aspect of the present invention is a method including the step of sintering a compact formed by pressure-molding of a mixed powder containing Fe powder and $TiB_2$ powder, the compact being sintered by (i) applying pressure with use of a pressure member made of graphite and (ii) heating at the same time, in the step of sintering, the compact being sintered such that: by (i) applying a pressure in a range of not less than 15 MPa and (ii) heating at a temperature of not less than 1323 K, (a) at least part of the $TiB_2$ is decomposed and (b) a network-like matrix is formed, the network-like matrix containing Fe as a main component and also containing Ti; the matrix contains αFe; and TiC dispersed in the matrix is generated by a reaction between Ti and C, the Ti being derived from the $TiB_2$, and the C being derived from the pressure member.

Advantageous Effects of Invention

An aspect of the present invention makes it possible to provide a Fe-based sintered body which has both of a high hardness and a high thermal conductivity and which can be more stably produced. Further, an aspect of the present invention makes it possible to provide a method of producing a Fe-based sintered body, which method makes it possible to more stably produce a Fe-based sintered body having both of a high hardness and a high thermal conductivity.

Figure 1:
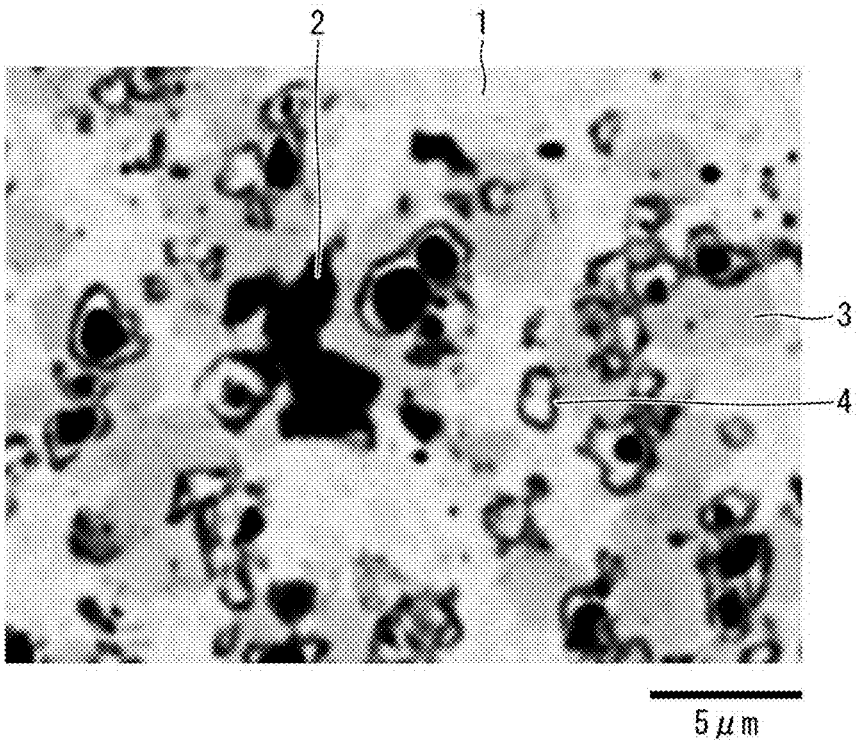
FIG. 1 is a backscattered electron image which was obtained by observing, with aid of an electron microscope, a material structure of a Fe-based sintered body in accordance with an embodiment of the present invention.
Figure 2:
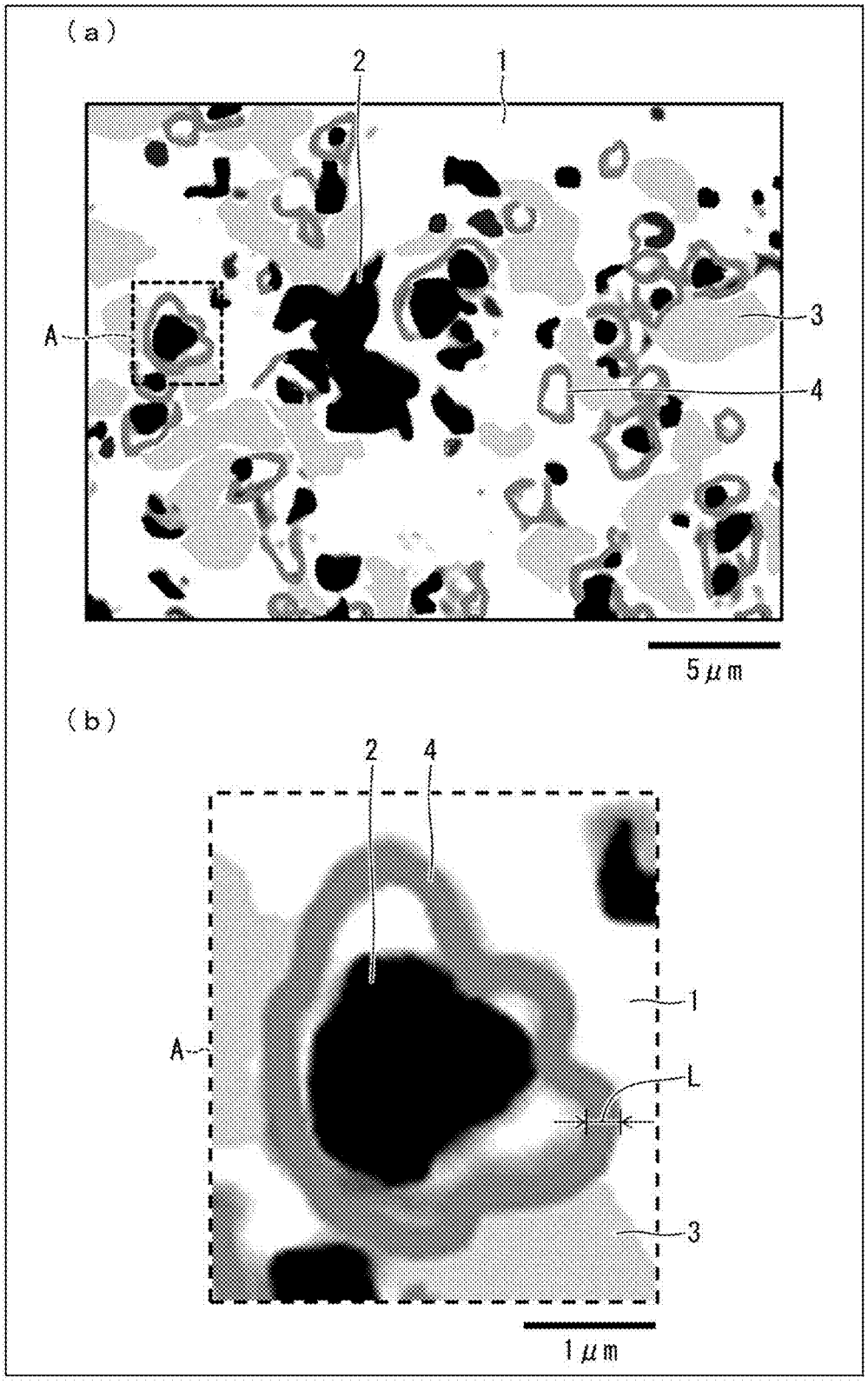

(a) of FIG. 2 is a schematic view of the backscattered electron image shown in FIG. 1. (b) of FIG. 2 is an enlarged view of a portion of the schematic view shown in (a) of FIG. 2.

Figure 3:
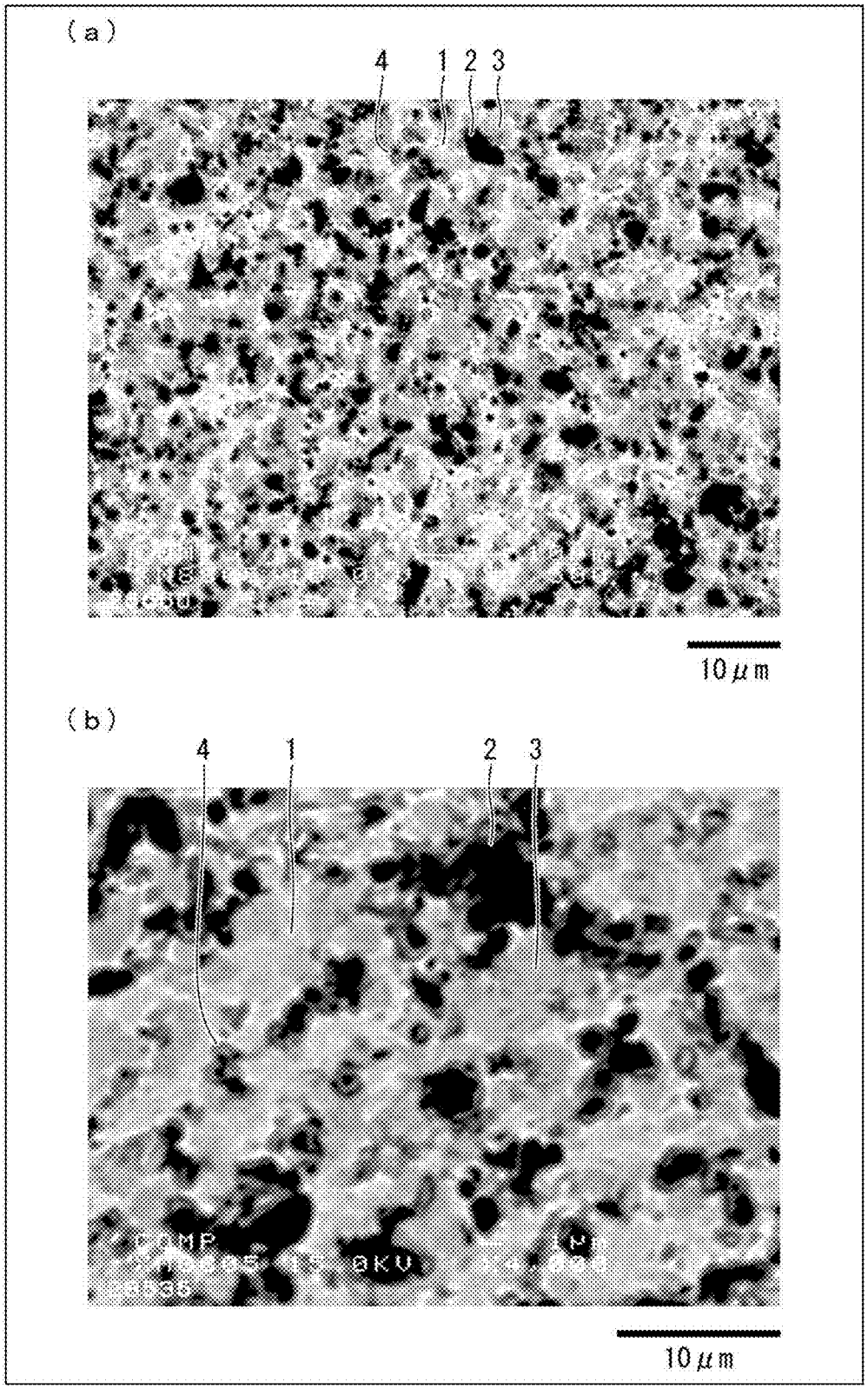

FIG. 3 shows backscattered electron images that were obtained by observing a sample, which had been polished so that it became possible to observe a material structure of a Fe-based sintered body in accordance with an embodiment of the present invention. (a) of FIG. 3 shows a backscattered electron image of a surface of the sample, and (b) of FIG. 3 shows a backscattered electron image obtained by observing a cross section of the sample.

Figure 4:
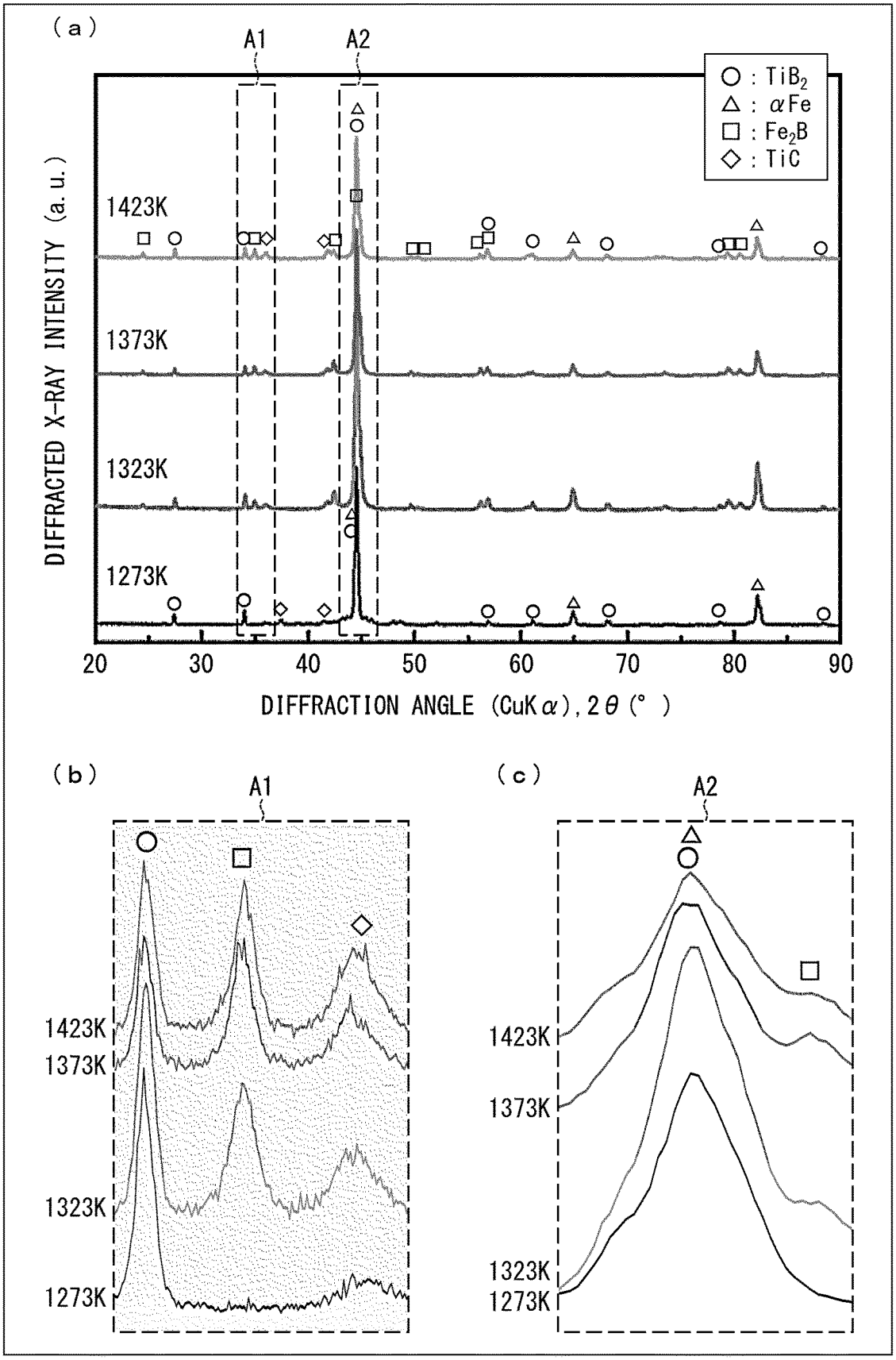

(a) of FIG. 4 is a diagram of examples of X-ray diffraction patterns of powder samples, which had been prepared at sintering temperatures in a range of 1273 K to 1423 K. (b) of FIG. 4 is an enlarged view of portions at a diffraction angle 2θ of approximately 35° in the X-ray diffraction patterns shown in (a) of FIG. 4 above. (c) of FIG. 4 is an enlarged view of portions at a diffraction angle 2θ of approximately 45° in the X-ray diffraction patterns shown in (a) of FIG. 4 above.

Figure 5:
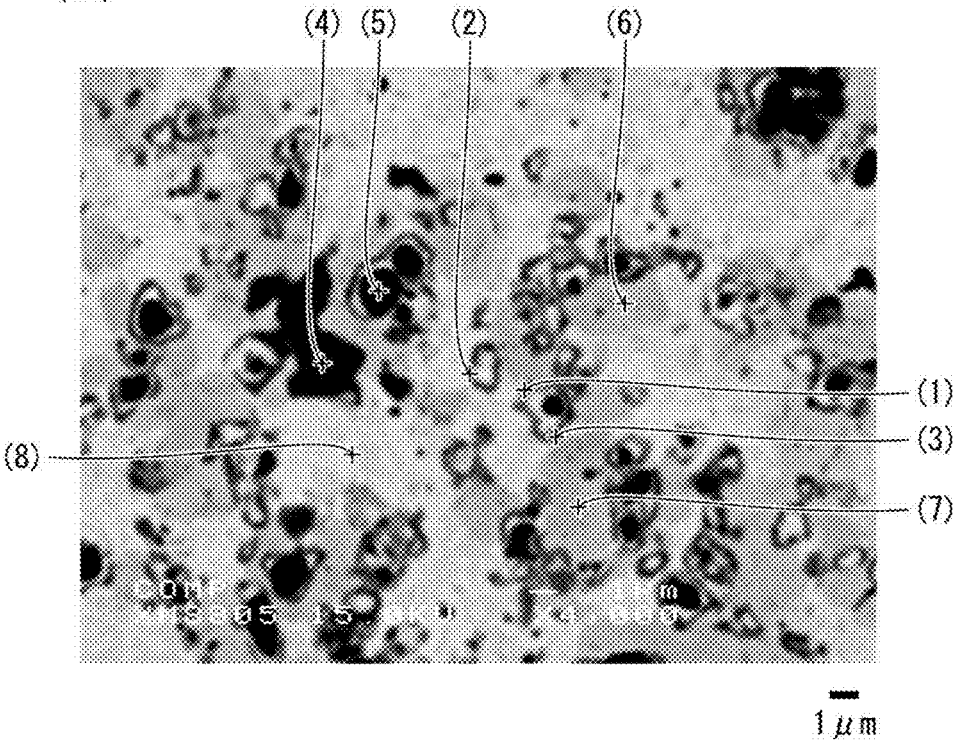

(a) of FIG. 5 is a diagram showing points in a backscattered electron image of a sample prepared at a sintering temperature of 1373 K, which points were subjected to local WDX analysis. (b) of FIG. 5 is a diagram showing results of composition analysis at eight points which were subjected to the WDX analysis.

FIG. 6 is a table showing test results of respective samples in a First Example and a Comparative Examples together.

Figure 7:
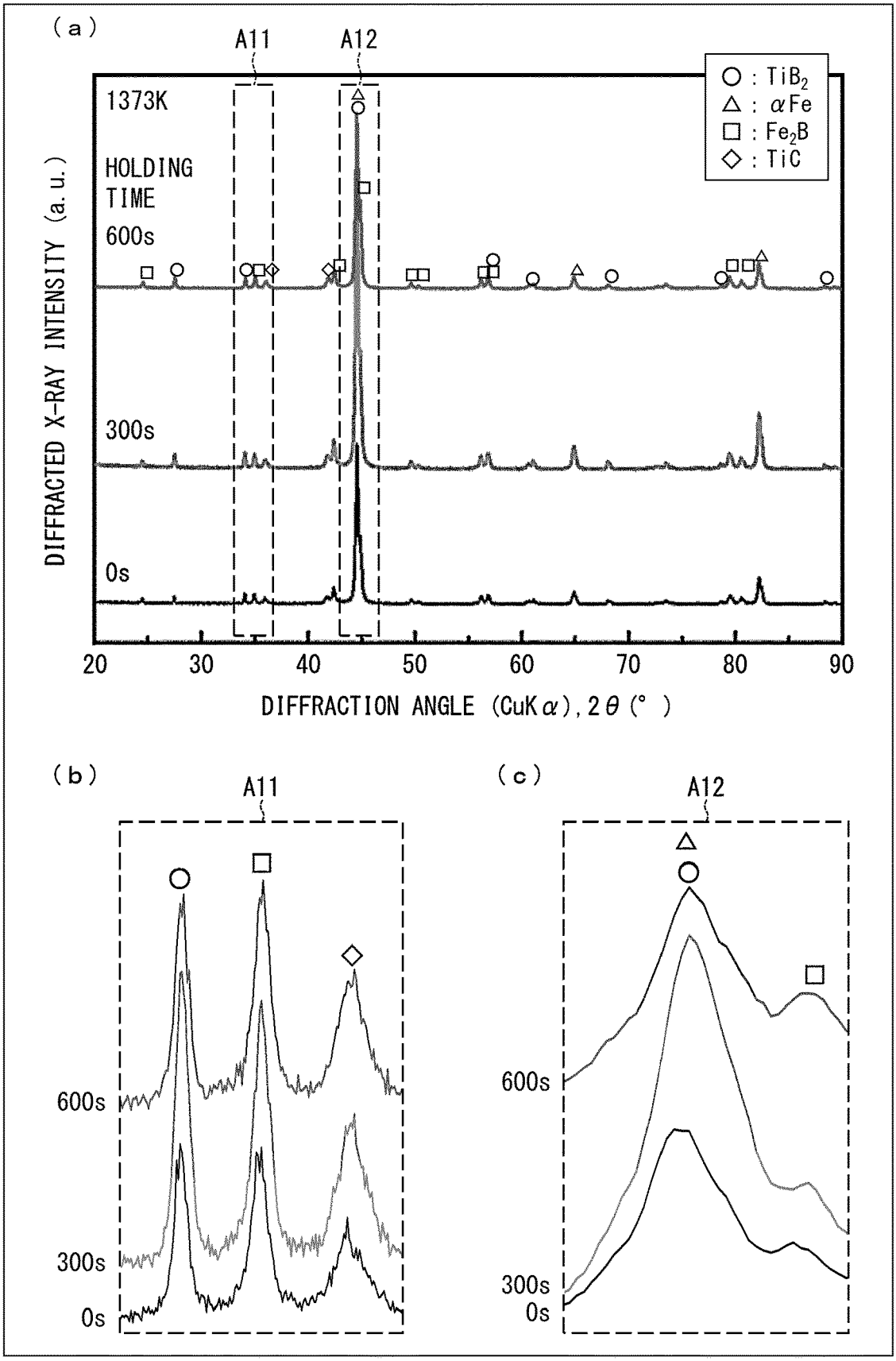

(a) of FIG. 7 is a diagram of examples of X-ray diffraction patterns of powder samples, which had been prepared under conditions where the sintering temperature was 1373 K and the holding time was substantially 0 seconds to 600 seconds. (b) of FIG. 7 is an enlarged view of portions at a diffraction angle 2θ of approximately 35° in the X-ray diffraction patterns as shown in (a) of FIG. 7 above. (c) of FIG. 7 is an enlarged view of portions at a diffraction angle 2θ of approximately 45° in the X-ray diffraction patterns as shown in (a) of FIG. 7 above.

FIG. 8 is a table showing test results of respective samples in a Second Example together.

Figure 9:
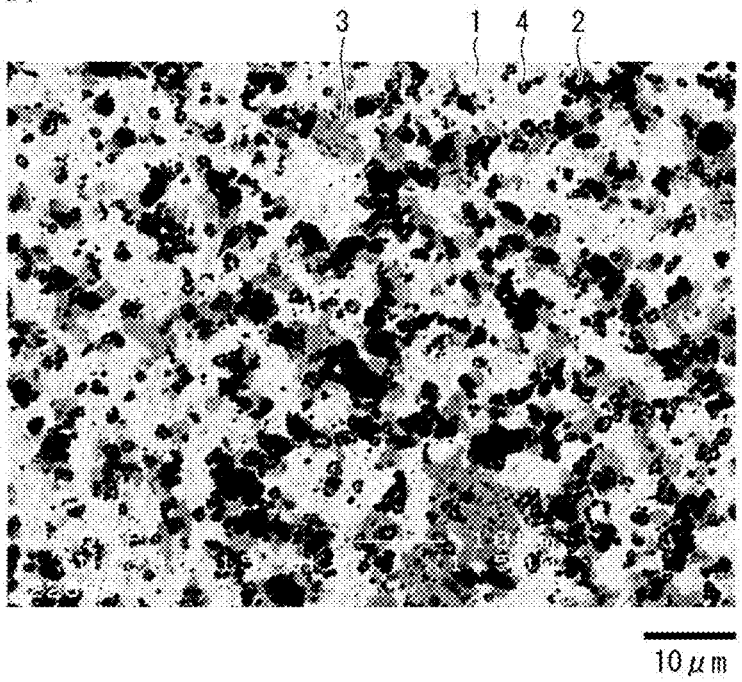

(a) of FIG. 9 is a backscattered electron image which was obtained by observing, with aid of an electron microscope, a material structure of a sample which had been prepared at a pure Fe:$TiB_2$ ratio of 80:20 in mass ratio. (b) of FIG. 9 is a table which shows test results of the sample together.

DESCRIPTION OF EMBODIMENTS

The following description will discuss embodiments of the present invention in more detail with reference to drawings. Note that the following description is intended to make the gist of the invention better understood, and does not limit the invention unless otherwise specified. Also note that a numerical range "A to B" herein means "not less than A and not more than B" unless otherwise specified in the present specification.

The following will briefly describe findings of the present invention, prior to a detailed description of a Fe-based sintered body and a method of producing the Fe-based sintered body in accordance with embodiments of the present invention.

BRIEF OVERVIEW OF FINDINGS OF INVENTION

In general, an alloy tool steel (e.g., SKD61) achieves a desired performance, by (i) containing a certain chemical component(s) and (ii) having undergone various heat treatments. For example, a variety of microstructures are formed in such a steel. Those microstructures act to improve hardness of the steel and at the same time, impedes thermal conductivity. Usually, as hardness of a substance increases, electron conductivity and phonon conductivity of the substance become lower. This results in an inferior thermal conductivity of the substance.

Patent Literature 1 discloses a technique for improving thermal conductivity of a tool steel at room temperature, by (i) reducing contents of carbon and chromium in a steel matrix and (ii) increasing phonon conductivity of a carbide which is a dispersed phase. However, an internal structure of steel may vary in many ways due to great influence of component composition, heat treatment, and various other conditions. Therefore, it is not easy to stably control the internal structure of steel to a desired state.

The inventors of the present application have tried to create a material which has both of a high hardness and a high thermal conductivity and which makes it possible to improve production stability, by taking an approach different from a conventional approach. As a result of diligent studies, the inventors have found that in a case where a Fe-based sintered body is produced by sintering a mixed powder of pure iron (Fe) and titanium boride ($TiB_2$), the Fe-based sintered body exhibits the following properties under regulated sintering conditions.

That is, non-equilibrium reactions in microregions are caused by sintering under a condition capable of supplying carbon (C) and under regulated conditions. As a result, a hard phase containing TiC is formed in a Fe-based sintered body. The hard phase can be obtained in a suitably and finely dispersed state in a Fe matrix.

Further, the Fe matrix not only has a network-like structure (net-like structure) but also contains αFe, and can suitably function as a heat conduction path. Note that in general, when cementite ($Fe_3C$) is generated in a material structure, the material structure may have a lowered thermal conductivity. In this respect, a Fe-based sintered body in accordance with an aspect of the present invention is produced by using, as a raw material, an iron which has a low carbon content. Meanwhile, in a production process of the Fe-based sintered body, when $TiB_2$ is decomposed, it is more likely that Ti and C are combined to generate TiC than Fe and C are combined to generate cementite. Therefore, the present Fe-based sintered body makes it possible to suppress generation of cementite during production of the Fe-based sintered body, and also makes it possible to reduce a cementite content.

From the above facts, the inventors of the present application obtained the findings that it is possible to obtain a Fe-based sintered body which exhibits both of a high hardness and a high thermal conductivity.

<Fe-Based Sintered Body>

The following description will discuss a Fe-based sintered body in accordance with an embodiment of the present invention, with reference to FIGS. 1 to 5. Note that a method of producing the Fe-based sintered body in accordance with the present embodiment will be described in detail later. FIG. 1 is a backscattered electron image which was obtained by observing, with aid of an electron microscope, an internal structure (material structure) of the Fe-based sintered body in accordance with the present embodiment.

As shown in FIG. 1, the Fe-based sintered body in accordance with the present embodiment includes a matrix (base) 1 containing Fe as a main component, and a dispersed phase containing various phases. The Fe-based sintered body of the present embodiment is generally formed (produced) by sintering mixed powder of Fe and $TiB_2$ under a condition capable of supplying C, as described above. The dispersed phase thus includes a particulate phase (first sub-phase) 2 containing $TiB_2$, which is a raw material, and a hard phase 4 containing fine TiC which is generated by a reaction between $TiB_2$ and C. Moreover, the dispersed phase further includes a by-product phase (second sub-phase) 3 containing $Fe_2B$ generated by a reaction between Fe and B which is supplied from $TiB_2$.

The following will describe the material structure of the Fe-based sintered body in accordance with the present embodiment in more detail, with reference to FIG. 2. (a) of FIG. 2 is a schematic view of the backscattered electron image shown in FIG. 1. (b) of FIG. 2 is an enlarged view of a portion of the above schematic diagram. Note that in FIG. 2, the matrix 1 is represented as a region which is in a lightest color (white), while the particulate phase 2 is represented as a region which is in a darkest color (black). Further, the by-product phase 3 is represented as a region in a color which is slightly darker (pale gray) than that of the matrix 1, while the hard phase 4 is represented as a region in a color between the color of the by-product phase 3 and the color of the particulate phase 2 in terms of darkness (dark gray).

(Matrix 1)

As shown in (a) of FIG. 2, the matrix 1 is a phase which accounts for a largest proportion in the Fe-based sintered body. The matrix 1 is formed in a network shape. In a case where, for example, the Fe-based sintered body as a whole is 100 parts by weight, the matrix 1 accounts for preferably not less than 75% by mass, and more preferably not less than 60% by mass and not more than 80% by mass in the Fe-based sintered body. Further, the matrix 1 is a phase containing Fe as a main component. The matrix 1 contains Fe at a concentration of not less than 99 atomic percent (hereinafter, expressed as at %), and preferably not less than 99.9 at %. The matrix 1 contains αFe. It is preferable that most of the matrix 1 be made of αFe. In a case where C atoms is present in the form of a solid solution in αFe, the αFe containing C atoms in the form of a solid solution is also referred to as a ferrite phase.

The network shape means, for example, that a continuous phase is formed in a net-like shape when the material structure is viewed in plane (when a cross section is observed) as shown in (a) of FIG. 2. The net-like structure of the matrix 1 has gaps in a net. In the gaps, the particulate phase 2, the by-product phase 3, and the hard phase 4 are scattered like islands, so that an island-like composite structure of the Fe-based sintered body is formed. Further, since the matrix 1 is polycrystalline, there is a crystal grain boundary in the network-like structure (net-like structure). Since the Fe-based sintered body is formed by sintering, there may be some voids in the matrix 1. The matrix 1 may have a concentration distribution and/or may have a plurality of phases. Such a matrix 1 is excellent in thermal conductivity.

Note that in practice, the matrix 1 has the network-like structure in a three-dimensional space although (a) of FIG. 2 is a schematic view of the material structure viewed in plane. In the Fe-based sintered body in accordance with the present embodiment, the matrix 1 can function as a continuous path (thermal conduction path) effective for thermal conduction.

Further, the matrix 1 may have a cementite content of not more than 5% by mass, and preferably not more than 1% by mass. The matrix 1 may have an αFe content of not less than 70% by mass, or not less than 60% by mass and not more than 80% by mass. Further, αFe may be in a ferrite phase, and a two-phase structure of the ferrite phase and cementite may be a layered structure. In addition, it is preferable that cementite, which is likely to hinder heat conduction, be in a localized state. The matrix 1 may satisfy at least one of the following conditions: the content of Cu is not more than 0.1% by mass; and the content of Si is not more than 0.1% by mass. Further, the matrix 1 may contain another impurity. However, such an impurity may act to, for example, lower a thermal conductivity or promote generation of a carbide. Therefore, it is preferable that the matrix 1 be produced so as to have a low impurity content.

(Particulate Phase 2)

The particulate phase 2 is present as a phase which is derived from the $TiB_2$ powder used in producing the Fe-based sintered body. Remaining part of the $TiB_2$ powder after a sintering reaction becomes the particulate phase 2. Accordingly, the particulate phase 2 is present, in the Fe-based sintered body, at a proportion which varies depending on conditions of the sintering reaction. Therefore, the proportion of the particulate phase 2 present is not particularly limited. The particulate phase 2 present accounts for, for example, a proportion of not less than 10% by mass in the Fe-based sintered body. Preferably, the particulate phase 2 present accounts for a proportion of not less than 15% by mass and not more than 20% by mass. Since the particulate phase 2 has a hardness which is higher than that of the matrix 1, the particulate phase 2 improves the hardness of the Fe-based sintered body.

(By-Product Phase 3)

The by-product phase 3 is a phase containing $Fe_2B$ generated by a reaction between Fe and B which is supplied from $TiB_2$. In other words, the by-product phase 3 is a phase containing $Fe_2B$ generated, as a by-product, by decomposition of $TiB_2$ in a reaction in which TiC is generated, during the sintering reaction. It is clear from (a) of FIG. 2 that the by-product phase 3 is formed at spots where the $TiB_2$ powder, which is a raw material, probably has originally existed. In addition, it is clear from (a) of FIG. 2 that the hard phase 4, which will be described below, is formed in the vicinity of the by-product phase 3 and the particulate phase 2.

Since the by-product phase 3 has a hardness which is higher than that of the matrix 1, the by-product phase 3 improves the hardness of the Fe-based sintered body.

(Hard Phase 4)

The following will describe the hard phase 4, with reference to (b) of FIG. 2 which shows the enlarged view of the portion of the backscattered electron image.

As shown in (b) of FIG. 2, the hard phase 4 in accordance with the present embodiment has a ring shape or a ring-like shape as a characteristic shape. In the present specification, the ring shape or the ring-like shape is used to mean not only a perfectly-round shape but also a distorted circular shape (shape irregularly curved in a circumferential direction) as in an example shown in (b) of FIG. 2.

In addition, the hard phase 4 may be a continuous ring (closed circle) which has no end in the circumferential direction, as in the example shown in (b) of FIG. 2, or may be a ring that is partially open. In other words, the hard phase 4 may have a shape which extends from one end to the other end.

The hard phase 4 has a width L of not more than 1.0 μm, preferably not more than 0.4 μm, and more preferably not less than 0.2 μm and not more than 0.4 μm, in a direction perpendicular to the circumferential direction. The width L can be measured as follows. That is, first, specified as shown in (b) of FIG. 2 is, for example, a border between the region (dark gray region) of the hard phase 4 and a region of another phase (e.g., the matrix 1 or the by-product phase 3) in the backscattered electron image. In the direction perpendicular to the circumferential direction of the hard phase 4, it is possible to measure the width L of the hard phase 4 on the basis of the border which has been specified. For example, the width L of one hard phase 4 can be an average value obtained by measuring widths at a plurality of positions of that one hard phase 4. The hard phase 4 can be also referred to as a finely dispersed phase in the matrix.

Note that as shown in (a) of FIG. 2, the hard phase 4 may be in various shapes, and may be in a string shape. In a case where the hard phase 4 is in a string shape, it is only necessary that the above-mentioned condition is satisfied by the width L of the hard phase 4 in a direction perpendicular to a longitudinal direction (a direction extending from one end to the other end) of the hard phase 4.

The hard phase 4 contains TiC, which is known to be excellent in hardness. Therefore, the Fe-based sintered body in the present embodiment can have a significantly improved hardness, by including the hard phase 4. Further, the matrix 1 functions as a heat conduction path, as described above. Consequently, the Fe-based sintered body in the present embodiment can have both of a high hardness and a high thermal conductivity.

The hard phase 4 is formed by a non-equilibrium reaction during a sintering reaction. The non-equilibrium reaction occurs, in minute regions, between the $TiB_2$ powder and C which is supplied by diffusion from a periphery to an inside of a green compact. Therefore, the Fe-based sintered body in accordance with the present embodiment can be stably produced, as compared to, for example, a case where an alloy tool steel is produced while a material structure of steel is controlled.

Specifically, the Fe-based sintered body in accordance with an aspect of the present invention has a hardness of not less than 300 HV (Vickers hardness) and a thermal conductivity of not less than 30 W/(m·K). Note that the hardness of not less than 300 HV can be roughly converted into Rockwell hardness and expressed as not less than 30 HRC (the conversion equation will be described later).

Note that the Fe-based sintered body may have a difference in hardness between a surface portion which is exposed to outside and an inside portion which is present closer to a center as compared to the surface portion. In the Fe-based sintered body in accordance with an aspect of the present invention, the hardness at the surface portion tends to be higher than that of the inside portion closer to the center, due to a reaction during sintering as described later. In the present specification, the term "hardness" means the hardness of the surface portion unless otherwise specified. What is important as a characteristic (material characteristic) of the Fe-based sintered body is the hardness of the surface portion.

The Fe-based sintered body in accordance with an aspect of the present invention may have a hardness of not less than 400 HV (40 HRC), or not less than 525 HV (50 HRC).

The Fe-based sintered body in accordance with an aspect of the present invention may have a thermal conductivity of not less than 40 W/(m·K), not less than 45 W/(m·K), or not less than 50 W/(m·K). In the present specification, the term "thermal conductivity" means a thermal conductivity at room temperature unless otherwise specified.

The Fe-based sintered body in accordance with an aspect of the present invention has a hardness of not less than 525 HV (50 HRC) and a thermal conductivity of not less than 40 W/(m·K).

<Method of Producing Fe-Based Sintered Body>

The following description will discuss in detail a method of producing the Fe-based sintered body of the present embodiment.

(Raw Materials)

As raw materials of the Fe-based sintered body, Fe fine powder and $TiB_2$ fine powder are used. Although these fine powders are not particularly limited in shape, these fine powders are preferably microscopic powders so that it is possible to obtain a mixed powder in which these fine powders are uniformly mixed in a powder mixing step (described later). For example, the Fe fine powder may have an average particle size of not more than 10 μm, and preferably not less than 3 μm and not more than 5 μm. Meanwhile, for example, the $TiB_2$ fine powder may have an average particle size of not more than 5 μm or less, and preferably not less than 2 μm and not more than 3 μm.

The Fe fine powder is preferably a pure iron fine powder having a carbon density of not more than 0.1% by mass. The $TiB_2$ fine powder may be a commercially available $TiB_2$ fine powder of a typical purity.

(Molding Step)

In a molding step, first, the Fe fine powder and the $TiB_2$ fine powder are uniformly mixed (mixing step). In this mixing step, it is only necessary to uniformly mix these powders, and specifically how to mix the powders is not particularly limited. For example, the powders may be mixed by using a ball mill. It is preferable that the powders be mixed by using a planetary ball mill. Further, in the mixing step, the powders may be subjected to wet mixing in which ethanol or the like is added, or subjected to dry mixing. When the powders are subjected to wet mixing, a drying step is carried out for volatilization of ethanol or the like used. There is no particular limitation on a specific drying method in the drying step.

Next, in the molding step, the mixed powder, in which the Fe fine powder and the $TiB_2$ fine powder are mixed together at a desired ratio (amount ratio), is molded (pressure-molded), so that a compact is obtained. There is no particular limitation on density of the compact thus obtained and on molding pressure. Note that in a sintering step described later, sintering may be carried out while the mixed powder is being molded (while the molding step is being carried out).

(Sintering Step)

In the sintering step in the present embodiment, sintering is carried out by heating and applying pressure at the same time. As a method of carrying out such sintering, it is possible to select and apply as appropriate a conventionally known solid phase sintering method. However, it is required to appropriately adjust sintering conditions (temperature, pressure, and atmosphere) so that the above-described Fe-based sintered body can be obtained.

In the sintering step, for example, the pressure is applied by using a pressure member which is made of graphite. This causes C derived from the pressure member to enter the compact when sintering is carried out. Therefore, C is supplied to a reaction field where a sintering reaction occurs, so that finer TiC is generated by that reaction between $TiB_2$ and C.

More specifically, the following reaction occurs in the sintering step. That is, first, the $TiB_2$ fine powder, which is a raw material, is at least partially decomposed. At the same time, particles of the Fe fine powder are fused to each other. This results in formation of a network-like matrix which contains Fe as a main component and which also contains Ti. Then, Ti derived from the $TiB_2$ fine powder reacts with C which is derived from the pressure member or the like (which may be C originally present in Fe). This reaction generates TiC which is finely dispersed in the matrix 1. Further, a temperature for the sintering is a temperature at which the matrix includes αFe and at which γFe is unlikely to be generated. The "temperature at which γFe is unlikely to be generated" refers to a temperature at which γFe is not likely to be generated during the sintering step under control of various electric discharge sintering conditions including a local temperature. Then, in the sintering step, C is mainly consumed to generate TiC. This allows the Fe-based sintered body to be produced while generation of cementite is suppressed. The method of producing the Fe-based sintered body in the present embodiment includes the sintering step in which such a reaction occurs.

In order to cause the above reaction, the sintering step is carried out at a temperature of not lower than 1323 K and at a pressure of not lower than 15 MPa. The above temperature is a sintering temperature which is set in a sintering device. In other words, the above temperature is a highest achievable temperature in the sintering step. The above temperature is preferably not lower than 1373 K, and more preferably not lower than 1423 K. Further, it is preferable that the above temperature be not lower than 1323 K and not higher than 1447 K. This is because at such a temperature, Fe and $Fe_2B$ are prevented from reacting with each other and from forming a liquid phase. The above pressure is preferably not lower than 15 MPa and not higher than 90 MPa.

In the sintering step, there is no particular limitation on a temperature increasing rate, but the temperature increasing rate may be, for example, 100 K/min. The highest achievable temperature may be kept for a period of time (holding time) of substantially 0 seconds, or longer than 0 seconds and not longer than 600 seconds.

Further, in the sintering step, it is preferable to use an electric discharge sintering method. The electric discharge sintering method is a method in which (i) electric current is applied between a formwork and a sinter material (powder) with which the formwork is filled and (ii) a sintering reaction is caused to occur by using heat (Joule heat) which is generated by electric current application. The electric discharge sintering method is carried out by using an electric discharge sintering machine. The electric discharge sintering machine carries out electric discharge sintering, while a material to be sintered (compact or powder) is covered by a graphite cylindrical die and a graphite punch such that the pressure is applied to the material by the graphite punch. The electric discharge sintering machine may carry out electric discharge sintering by application of pulse electric current or continuous electric current. The electric current to be applied only needs to be an electric current under a condition where a voltage of not less than a critical voltage is applied to the material to be sintered. Use of the electric discharge sintering method makes it possible to uniformly increase the temperature of the material to be sintered, so that a uniform and high-quality Fe-based sintered body can be obtained.

It should be noted here that in general, the sintering reaction is considered to proceed sufficiently at a temperature of approximately 1000 K, in a case where electric discharge sintering is carried out for producing a metal-based (e.g., Fe-based) sintered body. However, in a case where the sintering temperature is approximately 1000 K, the Fe-based sintered body of the present embodiment cannot be obtained because the hard phase 4 containing TiC is not generated at that temperature. As a result of diligent studies, the inventors of the present application have found that: in a case where the above-described sintering conditions (i.e., a temperature of not less than 1323 K and a pressure of not less than 15 MPa) are employed, the hard phase 4 containing TiC is generated and the Fe-based sintered body has an improved hardness though a mechanism for this is not completely clarified. The inventors have arrived at the present invention on the basis of such findings.

Note that in the sintering step, it is not necessary that a material of the punch etc. is graphite. If such is the case, sintering can be carried out after the compact has its surface coated with graphite or impregnated with C. It is alternatively possible to sinter a compact having a surface to which carbon powder is adhered.

In the above-described electric discharge sintering method, operations are relatively easy, and the temperature and pressure in sintering can be controlled in a relatively stable manner. This makes it easy to stably produce the Fe-based sintered body.

(Post-Step)

The method of producing the Fe-based sintered body may include the step of polishing and cleaning a surface of a sintered body after the sintering step.

FIG. 3 shows an example of a result of observing a surface and a cross-section of the Fe-based sintered body in accordance with an aspect of the present invention, which Fe-based sintered body is produced by the above-described steps. FIG. 3 shows backscattered electron images that were obtained by observing a sample, which had been polished so that it became possible to observe a material structure of the Fe-based sintered body in accordance with an embodiment of the present invention. (a) of FIG. 3 shows a backscattered electron image of the surface of the sample, and (b) of FIG. 3 shows a backscattered electron image obtained by observing the cross section of the sample.

It is clear from (a) and (b) of FIG. 3 that the Fe-based sintered body has the island-like composite structure (see FIG. 2) formed as described above. It is also clear that the hard phase 4 is formed inside (in the cross section of the sample of) the Fe-based sintered body.

(Hot Press Die)

Note that the Fe-based sintered body of the present embodiment may be used for production of a hot press die. The present invention encompasses the hot press die which is produced by using the Fe-based sintered body of the present embodiment.

(Variations)

In the method of producing the Fe-based sintered body in accordance with an aspect of the present invention, a calcination step may or may not be included between the molding step and the sintering step described later. When the method includes the calcination step, fine carbon particles are added to the Fe fine powder and the $TiB_2$ fine powder and mixed together, and a resultant mixed powder is molded so that a compact is obtained. Then, the calcination step is carried out by using the compact. The Fe-based sintered body in accordance with an aspect of the present invention may be produced by steps including the calcination step.

EXAMPLES

The following description will discuss the Fe-based sintered body in accordance with an aspect of the present invention in more detail, with reference to Examples and Comparative Examples, but the present invention is not limited to these Examples.

First Example (Sample Preparation)

Pure Fe fine powder having an average particle size in a range of 3 μm to 5 μm and $TiB_2$ fine powder having an average particle size in a range of 2 μm to 3 μm were dry-mixed at 100 rpm for 1 hour by using a planetary ball mill. A pure Fe:$TiB_2$ ratio was 80:20 in mass ratio (70:30 in volume ratio). In a container of the planetary ball mill, ceramic balls (balls) were provided such that an amount of the ceramic balls was 150 g per 15 g of the above powders to be mixed. Then, mixing was carried out.

After the above dry mixing, 15 ml to 20 ml of ethanol was added in the container of the planetary ball mill, and wet mixing was carried out for 3 hours. After this wet mixing, a resultant slurry was naturally dried, so that a mixed powder was obtained.

Then, the mixed powder thus obtained was loaded into a graphite framework of an electric discharge sintering machine. While pressure was applied by using a graphite punch, electric current was applied at the same time as heating, so that electric discharge sintering was carried out. The sintering temperature (maximum achievable temperature) was set at 1273 K to 1423 K, and the pressure was set at 50 MPa. The temperature increasing rate was set to 100 k/min, and the holding time at the maximum achievable temperature was set to substantially 0 seconds.

After sintering, a resultant sample was taken out from the electric discharge sintering machine, and polished. After this polishing, the sample was subjected to X-ray diffraction measurement, electron microscopy, thermal conductivity measurement, density measurement, and a hardness test.

(X-Ray Diffraction Measurement)

The sample was ground so as to be a powder sample, and the powder sample was subjected to X-ray diffraction measurement. As an applied X-ray, Cu Kα ray was used. FIG. 4 shows measurement results. (a) of FIG. 4 is a diagram of examples of X-ray diffraction patterns obtained by subjecting powder samples, which had been prepared at sintering temperatures in a range of 1273 K to 1423 K, to powder X-ray diffraction measurement with use of an X-ray diffraction device. (b) of FIG. 4 is an enlarged view of portions at a diffraction angle 2θ of approximately 35° in the X-ray diffraction patterns. (c) of FIG. 4 is an enlarged view of portions at a diffraction angle 2θ of approximately 45° in the X-ray diffraction patterns.

In FIG. 4, diffraction peaks of $TiB_2$ are marked with circles, diffraction peaks of αFe are marked with triangles, diffraction peaks of $Fe_2B$ are marked with squares, and diffraction peaks of TiC are marked with diamonds. As shown in (b) of FIG. 4, no clear peaks of TiC and $Fe_2B$ are found for the sample prepared at a sintering temperature of 1273 K. This means that in this sample, TiC is not generated. On the other hand, clear diffraction peaks of TiC and $Fe_2B$ were observed for the samples prepared at sintering temperatures of 1323 K, 1373 K, and 1423 K. It is also clear from the diffraction patterns shown in (c) of FIG. 4 that $Fe_2B$ diffraction peaks are observed for the samples prepared at the sintering temperatures of 1323 K, 1373 K, and 1423 K.

(Electron Microscopy)

Each of the samples was subjected to electron microscopy of a sample surface and a sample cross section. The sample surface is a surface that was exposed as a result of polishing a portion that had been in contact with the graphite punch during the electric discharge sintering. The sample cross section is a portion which had been inside the Fe-based sintered body and which was exposed as a result of polishing a cut surface obtained by cutting a sintered body after sintering.

Backscattered electron images of the sample surface and the sample cross section were captured, and the sample surface and the sample cross section were subjected to composition analysis by wavelength dispersive X-ray analysis (WDX). In addition, concentrations of $TiB_2$ at the sample surface and at the sample cross section were measured by WDX. As a result, it was found that a higher sintering temperature resulted in a lower $TiB_2$ concentration at each of the sample surface and the sample cross section (see FIG. 6, which will be described later).

Further, the sample surface of the sample prepared at a sintering temperature of 1373 K was subjected to local WDX analysis. FIG. 5 shows results of the local WDX analysis. (a) of FIG. 5 is a diagram showing points in a backscattered electron image of the sample, which points were subjected to the local WDX analysis. (b) of FIG. 5 is a diagram showing results of composition analysis at eight points which were subjected to the WDX analysis.

It is clear from (a) and (b) of FIG. 5 that TiC is present together with the matrix 1 containing Fe as a main component, at points (1) to (3) at each of which a ring-shaped hard phase 4 is observed. It is also clear that $TiB_2$ is present at points (4) and (5) where the particulate phase 2 in a darker color (black) is observed. Further, it is clear that $Fe_2B$ is present at points (6) and (7) where the by-product phase 3 is observed, and at point (8) where the matrix 1 is observed, the sample was substantially entirely made of Fe.

(Thermal Conductivity Measurement, Density Measurement, and Hardness Test)

The thermal conductivity measurement was carried out by a steady-state method (a method of measuring a thermal conductivity by giving a steady-state temperature gradient to a sample to be measured). That is, one end of the sample to be measured was set to a high temperature and the other end of the sample was set to a low temperature. Then, temperatures at respective points in the sample were measured, so that a thermal conductivity was obtained.

Density measurement was carried out by using the Archimedes method. A relative density was determined by dividing, by a theoretical density, a density which had been measured according to the Archimedes method.

The hardness test was carried out for the sample surface and an inside of the sample, by the Vickers hardness test. In the hardness test, a test force was set to 30 kg and a retention time was 10 seconds.

(Results)

FIG. 6 shows results of the above-described tests together. Note that the thermal conductivity and the Vickers hardness are shown together with errors which were obtained by carrying out more than one measurement. The errors are the standard deviation.

Note that Vickers hardness (HV) can be converted into Rockwell hardness (HRC) by using the following conversion equations.

(i) Cases where the Vickers hardness is not less than 520 HV;

$$HRC=(100\times HV-15100)/(HV+223)$$

(ii) Cases where the Vickers hardness is not less than 200 HV and less than 520 HV;

$$HRC=(100\times HV-13700)/(HV+223).$$

In Comparative Example 1 in which the sintering temperature is 1273 K, the thermal conductivity is approximately 44 W/(m·K) and the Vickers hardness is approximately 220 HV. In a sample of Comparative Example 1, no TiC is generated in a material structure, and there is no hard phase 4 which increases the hardness. Thus, although the sample of Comparative Example 1 exhibits a high thermal conductivity due to thermal conductivity provided by the matrix 1, the hardness of this sample is inadequate.

In contrast, it is clear that in Examples 1 to 3 in each of which the sintering temperature is in a range of 1323 K to 1423 K, the hardness improves as the sintering temperature increases. In terms of the thermal conductivity, Examples 1 and 2 are slightly inferior to Comparative Example 1. Although the reason for this is not clear, it is inferred that it may be one factor that Ti and C are in the form of a solid solution in the matrix 1. As the sintering temperature increases, TiC is more easily formed since diffusion of Ti and C is promoted.

It is also clear from each of the results of Examples 1 to 3 that as the sintering temperature increases, $TiB_2$ concentrations at the sample surface and inside the sample decrease. It is considered that a larger decrease in $TiB_2$ concentration after sintering results in a larger amount of TiC generated. Further, as the sintering temperature increased, the density and the relative density increased.

It is clear from the First Example that an aspect of the present invention makes it possible to more stably produce a Fe-based sintered body which has both of a high hardness and a high thermal conductivity.

Second Example

In the First Example, samples were prepared at different sintering temperatures in a range from 1273 K to 1423 K, respectively, while the holding time at the maximum achievable temperature was substantially 0 seconds. On the other hand, in the Second Example, samples were prepared by setting the holding time at the maximum achievable temperature to substantially 0 seconds, 300 seconds, and 600 seconds, respectively, while the sintering temperature was kept at 1373 K.

The samples were prepared under the same conditions as those in the First Example described above, except that the sintering temperature was set to 1373 K and the holding time at the maximum achievable temperature was set to substantially 0 seconds, 300 seconds, and 600 seconds. Further, various tests were carried out as in the First Example described above.

FIG. 7 shows results of X-ray diffraction measurement. (a) of FIG. 7 is a diagram of examples of X-ray diffraction patterns obtained by subjecting powder samples, which had been prepared under conditions where the sintering temperature was 1373 K and the holding time was substantially 0 seconds to 600 seconds, to powder X-ray diffraction measurement with use of an X-ray diffraction device. (b) of FIG. 7 is an enlarged view of portions at a diffraction angle $2\theta$ of approximately 35° in the X-ray diffraction patterns. (c) of FIG. 7 is an enlarged view of portions at a diffraction angle $2\theta$ of approximately 45° in the X-ray diffraction patterns.

In FIG. 7, correspondence between various marks and materials is same as that described above with reference to FIG. 4. As shown in (b) in FIG. 7, as the holding time increased, diffraction peak intensity of TiC increased. In addition, as shown in (c) of FIG. 7, as the holding time increased, diffraction peak intensity of $Fe_2B$ increased.

FIG. 8 shows results of the various tests together. Note that the thermal conductivity and the Vickers hardness are shown together with errors which were obtained by carrying out more than one measurement.

It is clear from the results of Examples 4 to 6 in which the holding times are substantially 0 seconds, 300 seconds, and 600 seconds, respectively, that as the holding time increases, the thermal conductivity and the hardness significantly improve. Further, as the holding time increased, the density and the relative density increased.

As described above, a Fe-based sintered body in accordance with an aspect of the present invention can have an improved thermal conductivity and an improved hardness by increasing the sintering temperature and increasing the holding time. In other words, the thermal conductivity and the hardness can be controlled in a relatively simple manner by controlling sintering conditions. Therefore, it is clear that an aspect of the present invention makes it possible to more stably produce a Fe-based sintered body which has both of a high hardness and a high thermal conductivity.

Third Example

In the First and Second Examples, the samples were each prepared by setting the pure Fe:$TiB_2$ ratio to 80:20 in mass ratio. On the other hand, in the Third Example, a sample was prepared by setting the pure Fe:$TiB_2$ ratio to 87:13 in mass ratio (Example 7). Meanwhile, the sintering temperature was set to 1373 K, and the holding time at the maximum achievable temperature was set to 600 seconds. Except for these conditions, the sample was prepared under the same conditions as those in the First Example described above. Further, various tests were carried out as in the First Example described above.

FIG. 9 shows results thus obtained. (a) of FIG. 9 is a backscattered electron image which was obtained by observing, with aid of an electron microscope, a material structure of the sample prepared. (b) of FIG. 9 is a table which shows test results of the sample together.

As shown in (a) of FIG. 9, the sample of the Third Example has a matrix 1, a particulate phase 2, a by-product phase 3 and a hard phase 4, as in the First and Second Examples. Further, as shown in (b) of FIG. 9, it is possible to obtain a Fe-based sintered body which has both of a high hardness and a high thermal conductivity, also under conditions of the Third Example.

Note that the following is clear from a comparison between the Third Example and Example 6 of the Second Example (see FIG. 8). That is, a larger amount of $TiB_2$ introduced results in an improved hardness and an improved thermal conductivity. Accordingly, the Fe-based sintered body in accordance with an aspect of the present invention makes it possible to relatively easily control the thermal conductivity and the hardness, by controlling a ratio of raw materials (pure Fe:$TiB_2$ ratio) to be introduced. Therefore, it is clear that an aspect of the present invention makes it possible to more stably produce a Fe-based sintered body which has both of a high hardness and a high thermal conductivity.

ADDITIONAL MATTERS

The present invention is not limited to the description of the embodiments above, but may be altered in various ways by a skilled person within the scope of the claims. The present invention encompasses, in its technical scope, any embodiment based on an appropriate combination of technical means disclosed in the above description.

REFERENCE SIGNS LIST

1 matrix
2 particulate phase (first sub-phase)
3 by-product phase (second sub-phase)
4 hard phase

The invention claimed is:

1. A Fe-based sintered body comprising:
a matrix containing Fe as a main component; and
a dispersed phase in the matrix,
the matrix being formed in a network shape and containing $\alpha$Fe, the dispersed phase including a hard phase containing TiC, the hard phase having a ring shape or a ring-like shape, and the hard phase having a width of not more than 1.0 μm in a direction perpendicular to a circumferential direction of the hard phase, wherein the matrix accounts for not less than 60% by mass in the Fe-based sintered body, and the matrix has a cementite content of not more than 5% by mass, and wherein the Fe-based sintered body has a surface portion which is exposed to outside and an inside portion which is present closer to a center as compared to the surface portion, and the surface portion has a higher hardness than the inner portion.

2. The Fe-based sintered body as set forth in claim 1, having a hardness of not less than 50 HRC and a thermal conductivity of not less than 40 W/(m·K).

3. The Fe-based sintered body as set forth in claim 1, wherein the matrix has an αFe content of not less than 70% by mass.

4. The Fe-based sintered body as set forth in claim 1, wherein the matrix has a Cu content of not more than 0.1% by mass and an Si content of not more than 0.1% by mass.

5. The Fe-based sintered body as set forth in claim 1, wherein the dispersed phase further includes a first sub-phase containing $TiB_2$, and a second sub-phase containing $Fe_2B$.

6. The Fe-based sintered body as set forth in claim 5, wherein the first sub-phase accounts for not less than 10% by mass in the Fe-based sintered body and has a higher hardness than the matrix, and the second sub-phase has a higher hardness than the matrix.

7. The method of producing a Fe-based sintered body as set forth in claim 1, the method comprising the step of sintering a compact formed by pressure-molding of a mixed powder containing Fe powder and $TiB_2$ powder, the compact being sintered by (i) applying pressure with use of a pressure member made of graphite and (ii) heating at the same time, in the step of sintering, the compact being sintered such that:

by (i) applying a pressure of not less than 15 MPa and (ii) heating at a temperature of not less than 1323 K, (a) at least part of the $TiB_2$ is decomposed and (b) a network-like matrix is formed, the network-like matrix containing Fe as a main component and also containing Ti;

the matrix contains αFe; and

TiC dispersed in the matrix is generated by a reaction between Ti and C, the Ti being derived from the $TiB_2$, and the C being derived from the pressure member.

8. The method as set forth in claim 7, wherein in the step of sintering, the compact is sintered by an electric discharge sintering method.

9. A hot press die produced by using a Fe-based sintered body as recited in claim 1.

10. A Fe-based sintered body comprising:

a matrix containing Fe as a main component; and a dispersed phase in the matrix, the matrix being formed in a network shape and containing αFe, and the dispersed phase including a hard phase, the hard phase containing TiC and having a width of not more than 1.0 μm in a direction perpendicular to a longitudinal direction of the hard phase, wherein the matrix accounts for not less than 60% by mass in the Fe-based sintered body, and the matrix has a cementite content of not more than 5% by mass, and wherein the Fe-based sintered body has a surface portion which is exposed to outside and an inside portion which is present closer to a center as compared to the surface portion, and the surface portion has a higher hardness than the inner portion.

11. The Fe-based sintered body as set forth in claim 10, having a hardness of not less than 50 HRC and a thermal conductivity of not less than 40 W/(m·K).

12. The Fe-based sintered body as set forth in claim 10, wherein the matrix has an αFe content of not less than 70% by mass.

13. The Fe-based sintered body as set forth in claim 10, wherein the matrix has a Cu content of not more than 0.1% by mass and an Si content of not more than 0.1% by mass.

14. The Fe-based sintered body as set forth in claim 10, wherein the dispersed phase further includes a first sub-phase containing TiB2, and a second sub-phase containing Fe2B.

15. The Fe-based sintered body as set forth in claim 14, wherein the first sub-phase accounts for not less than 10% by mass in the Fe-based sintered body and has a higher hardness than the matrix, and the second sub-phase has a higher hardness than the matrix.

* * * * *